US006698874B2

(12) United States Patent
Katsuki

(10) Patent No.: US 6,698,874 B2
(45) Date of Patent: Mar. 2, 2004

(54) INK ACCEPTOR SOLUTION FOR PRETREATMENT OF CLOTH FOR INK-JET PRINTING, A CLOTH PRETREATED WITH THE SAME FOR INK-JET PRINTING, AND AN INK-JET PRINTING PROCESS FOR CLOTH COMPRISING SUCH PRETREATMENT OF THE CLOTH

(75) Inventor: Toshiharu Katsuki, Fukui (JP)

(73) Assignee: Seiren Co., LTD, Fukui (JP)

( * ) Notice: Subject to any disclaimer, the term of this patent is extended or adjusted under 35 U.S.C. 154(b) by 28 days.

(21) Appl. No.: 10/106,969

(22) Filed: Mar. 26, 2002

(65) Prior Publication Data

US 2002/0196321 A1 Dec. 26, 2002

(30) Foreign Application Priority Data

Mar. 26, 2001 (JP) ..... 2001-088111

(51) Int. Cl.[7] ..... B41J 2/17; B41J 2/01

(52) U.S. Cl. ..... 347/95; 347/101

(58) Field of Search ..... 347/101, 95, 105, 347/106; 427/288, 394, 384; 428/195

(56) References Cited

U.S. PATENT DOCUMENTS 4,426,206 A * 1/1984 Hosokawa et al. ..... 8/528
4,725,849 A * 2/1988 Koike et al. ..... 347/106
6,137,516 A * 10/2000 Malhotra et al. ..... 347/105

* cited by examiner

*Primary Examiner*—Michael S Brooke
(74) *Attorney, Agent, or Firm*—Dilworth & Barrese LLP.

(57) ABSTRACT

An ink acceptor solution for treatment of cloth for ink-jet printing, which comprises a naturally occurring polymeric thickening agent as an ink acceptor and an antiseptic agent thermally decomposable at a temperature of 50 to 200° C., and if desired, a semi-synthetic polymeric thickening agent.

11 Claims, No Drawings

INK ACCEPTOR SOLUTION FOR PRETREATMENT OF CLOTH FOR INK-JET PRINTING, A CLOTH PRETREATED WITH THE SAME FOR INK-JET PRINTING, AND AN INK-JET PRINTING PROCESS FOR CLOTH COMPRISING SUCH PRETREATMENT OF THE CLOTH

FIELD OF THE INVENTION

The present invention relates to ink-jet printing on cloth and more particularly to an ink acceptor solution for pretreatment of cloth for ink-jet printing, a cloth pretreated with the same for ink-jet printing and an ink-jet printing process for cloth comprising such pretreatment of the cloth.

BACKGROUND OF THE INVENTION

In recent years, ink-jet printing has made such great progress that it is on the road to establishing its important position in the industrial field. Especially in the textile industry, ink-jet printing has attracted attention as a technology for high value added products as it can dye cloth in full color without any loss in its inherent characteristic tactile properties, allowing easy recording of photographic sharp images on cloth that has been impossible to realize with any conventional printing process.

In addition, ink-jet printing can meet requirements for production in small lot sizes, short delivery times and other such styles as demand waste-minimized efficient processes, as well as can avoid any excessive use of dyes and water, allowing it to be not only environmentally friendly, but also advantageous in sharp cost reduction, all of which facts combined have contributed to a growing increase in its needs as a next-generation printing system.

Notwithstanding the above, however, ink-jet printing for cloth, which normally involves its pretreatment with an ink acceptor for formation of an ink accepting layer on its surface to prevent the bleeding of the ink thereafter applied onto it that may otherwise occur, has now suffered from environmentally-related concern because of this ink accepting layer asserted as a structure causing environmental pollution.

As evidence of such assertion, for example, Japanese Patent JP-A-05-179577 proposes the use of water-absorptive resin as an ink acceptor to be applied to cloth for formation of an ink accepting layer on it before its ink-jet printing, presenting exclusively PVA and other similar synthetic polymers as examples of such water-absorptive resin, which, although advantageous due to their low prices, are hard to degrade, presenting a problem of environmental pollution.

As another such example, Japanese Patent JP-A-06-146178 has discloses the use of carboxymethylcellulose or sodium alginate as an ink acceptor to form an ink accepting layer on cloth for ink-jet printing, the former of which is a natural cellulose processed to become water-soluble, performing excellently for such a purpose, although still hardly degradable, posing an environmental pollution problem. The latter, on the other hand, is a naturally occurring substance, which, for that very reason, is easily degradable and poorly heat-resistant, failing to achieve its stability over time when exposed to temperature change.

As a further example in this connection, Japanese Patent JP-A-07-252785, in addition to the above polymers, discloses starch oxide, methylcellulose and hydroxyethylcellulose for use as ink acceptors, all of which, however, are also hardly degradable substances causing environmental pollution.

OBJECT OF THE INVENTION

It is therefore an object of the present invention to solve the problems involved in the relevant prior proposals as mentioned above. More particularly, the objects of the present invention are to provide (i) an ink acceptor solution for pretreatment of cloth for ink-jet printing, which is excellent in stability over time and ease of handling, (ii) a cloth pretreated with the same, which is environmentally friendly, but not less inferior in ink acceptability to its conventional counterpart, capable of being ink-jet printed with good quality color image rendition, and (iii) an ink-jet printing process for cloth comprising application of such pretreatment solution to the cloth.

SUMMARY OF THE INVENTION

As a result of their earnest efforts to solve the above-mentioned problems involved in the relevant prior proposals, the inventors of the present invention discovered that the combination of a highly biodegradable naturally occurring polymeric thickening agent as an ink acceptor and a thermally decomposable antiseptic agent provides (i) an ink acceptor solution for pretreatment of cloth for ink-jet printing, which is excellent in storage stability, as well as environmentally friendly when disposed of after completion of its function for such pretreatment, (ii) a cloth pretreated with the same for ink-jet printing, and (iii) an ink-jet printing process for cloth comprising pretreatment of the cloth with such ink acceptor solution, designed in consideration of both technological and environmental perspectives. The discovery of the above has led to the completion of the present invention.

The present invention is summerized as follows:

1. An ink acceptor solution for pretreatment of cloth for ink-jet printing, which is comprises a naturally occurring polymeric thickening agent dissolved in water as an ink acceptor and an antiseptic agent thermally decomposable at a temperature of 50 to 200° C.;
2. An ink acceptor solution for pretreatment of cloth for ink-jet printing as specified in aspect 1, the BOD/COD value of which ranges from 0.3 to 3;
3. An ink acceptor solution for pretreatment of cloth for ink-jet printing as specified in aspect 1 or 2, which further contains a semi-synthetic polymeric thickening agent;
4. An ink acceptor solution for pretreatment of cloth for ink-jet printing as specified in aspect 3, in which said semi-synthetic polymeric thickening agent is contained at a concentration of 5 to 40% by weight relative to said naturally occurring polymeric thickening agent;
5. An ink acceptor solution for pretreatment of cloth for ink-jet printing as specified in aspect 3 or 4, in which said semi-synthetic polymeric thickening agent is a carboxymethylated water-soluble polysaccharide;
6. An ink acceptor solution for pretreatment of cloth for ink-jet printing as specified in any one of aspects 1 to 5, the PVI value of which ranges from 0.3 to 1.0;
7. A cloth for ink-jet printing, which has an ink accepting layer comprising a naturally occurring polymeric thickening agent as an ink acceptor and an antiseptic agent, which is thermally decomposable at a temperature of 50 to 200° C.;
8. A cloth for ink-jet printing as specified in aspect 7, in which said ink accepting layer further contains a semi-synthetic polymeric thickening agent;
9. A cloth for ink-jet printing as specified in aspect 8, in which said semi-synthetic polymeric thickening agent is contained at a concentration of 5 to 40% by weight relative to said naturally occurring polymeric thickening agent;

10. A cloth for ink-jet printing as specified in aspect 8 or 9, in which said semi-synthetic polymeric thickening agent is a carboxymethylated water-soluble polysaccharide;
11. An ink-jet printing process, which comprises (1) pretreating cloth with an ink acceptor solution comprising an naturally occurring polymeric thickening agent dissolved in water as an ink acceptor and an antiseptic agent thermally decomposable at a temperature of 50 to 200° C., to form an ink accepting layer on the cloth, (2) ink-jet printing onto the pretreated cloth, (3) thermally treating the ink-jet printed cloth to decompose the antiseptic agent contained in the ink accepting layer, and (4) washing the thermally-treated cloth to remove the ink accepting layer from it;
12. An ink-jet printing process as specified in aspect 11, in which the BOD/COD value of said pretreatment solution ranges from 0.3 to 3;
13. An ink-jet printing process as specified in aspect 11 or 12, in which said pretreatment solution further contains a semi-synthetic polymeric thickening agent;
14. An ink-jet printing process as specified in aspect 13, in which said semi-synthetic polymeric thickening agent is contained in said pretreatment solution at a concentration of 5 to 40% by weight relative to the naturally occurring polymeric thickening agent;
15. An ink-jet printing process as specified in aspect 13 or 14, in which said semi-synthetic polymeric thickening agent contained in said pretreatment solution is a carboxymethylated water-soluble polysaccharide;
16. An ink-jet printing process as specified in any one of aspects 11 to 15, in which the PVI value of said pretreatment solution ranges from 0.3 to 1.0;
17. An ink-jet printing process as specified in any one of aspects 11 to 16, in which the amounts of said naturally occurring polymeric thickening agent, antiseptic agent and water are 0.1 to 10% by weight, 0.005 to 1% by weight and 70 to 99.9% by weight, respectively, based on the weight of said pretreatment solution.
18. An ink-jet printing process as specified in any one of aspects 11 to 17, in which said antiseptic agent is an isothiazoline- or triazine-based one;
19. An ink-jet printing process as specified in any one of aspects 11 to 18, in which said antiseptic agent is 5-chloro-2-methyl-4-isothiazoline-3-one or 2-methyl-4-isothiazoline-3-one;
20. An ink-jet printing process as specified in any one of aspects 11 to 19, in which said naturally occurring polymeric thickening agent is selected from the group consisting of starch, funori (seaweed-derived glue), agar, sodium alginate, tororo-aoi (Hibiscus manihot L), tragacanth gum, gum Arabic, dextran, konnyaku flour (glucomannan), nikawa (animal glue), gelatin, casein, collagen, guar gum, locust bean gum, xanthan gum and carrageenan; and
21. An ink-jet printing process as specified in any one of aspects 11 to 20, in which said naturally occurring polymeric thickening agent is sodium alginate.

DETAILED DESCRIPTION OF THE INVENTION

The above-mentioned aspects of the present invention will be described in further detail as follows.

The useful ink acceptor contained in such pretreatment solution for cloth for ink-jet printing as referred to in the present invention or constituting an ink accepting layer formed on the cloth as a result of the application of said pretreatment solution to it according to the present invention comprises a naturally occurring polymeric thickening agent, which is environmentally friendly.

Specific examples of such a naturally occurring polymeric thickening agent include starch, funori (seaweed-derived glue), agar, sodium alginate, tororo-aoi (Hibiscus manihot L), tragacanth gum, gum Arabic, dextran, konnyaku flour (glucomannan), nikawa (animal glue), gelatin, casein, collagen, guar gum, locust bean gum, xanthan gum and carrageenan.

Ink-jet printing, in which droplets of ink are jetted onto a recording medium to create images on the medium, requires it to absorb the ink droplets without causing them to bleed. This is particularly true when ink-jet printing is applied onto cloth as a recording medium, which requires absorption of ink droplets in large amounts, making it desirable for the cloth to have such an ink accepting layer formed on it that is excellent in water absorptivity. In addition, ink-jet printing onto cloth, as desired to occur with the ink applied onto it allowed to reach its inner portion, requires it to have an ink accepting layer formed on it, penetrating into its inner depth to a similar extent, which makes it desirable to use an ink acceptor so flowable when dissolved in water for application to it as to enable such penetration. Among the naturally occurring polymeric thickening agents useful in the present invention that can meet the above requirements as an ink acceptor, the sodium alginate and guar gum are preferred. The particularly preferred one is sodium alginate. A useful pretreatment solution according to the present invention preferably contains one or more of such naturally occurring polymeric thickening agents at a concentration of 0.1% to 10% by weight. If the concentration of such a naturally occurring polymeric thickening agent contained in the pretreatment solution is less than 0.1% by weight, it fails to prevent the bleeding of the ink. Conversely, if such a naturally occurring polymeric thickening agent is contained in the pretreatment solution at a concentration of more than 10% by weight, its fails to allowing uniform distribution of the naturally occurring polymeric thickening agent applied onto the cloth to offer ink-jet printed goods with excellently even coloration.

On the other hand, naturally occurring polymeric thickening agents such as proposed herein as an ink acceptor to be applied to cloth for ink-jet printing are easily degradable and therefore environmentally friendly, while, because of their poor heat resistance and resultant poor stability over time against temperature change, having the disadvantage of being difficult to preserve when dissolved in water to prepare a pretreatment solution for cloth for ink-jet printing. Such a pretreatment solution can be effectively preserved by addition of an antiseptic agent to it, which, if non-decomposable, has the disadvantage of killing even bacteria useful in degrading organic waste including waste water containing the naturally occurring thickening agent applied to cloth and removed thereafter from the cloth upon completion of its function, making it difficult or impossible to discharge the waste water for sewage disposal from a environmental point of view.

According to the present invention, the ink acceptor contained in a solution for pretreatment of cloth for ink-jet printing is prevented from degrading by the presence of an antiseptic agent in the solution until its application to the cloth which is thereafter ink-jet printed, after which it is removed from the ink-jet printed cloth when it completes its function for such pretreatment with the antiseptic agent concurrently decomposed to make it easily degradable, allowing its reasonable discharge for sewage disposal. This concept is a major feature of the present invention.

More specifically, the present invention proposes an ink acceptor solution for pretreatment of cloth for ink-jet printing, containing a naturally occurring polymeric thickening agent as an ink acceptor and a thermally-decomposable antiseptic agent, the application of which to the cloth is followed by passing it through a drying process prior to its ink-jet printing, or alternatively ink-jet printing it with its subsequent thermal treatment process for its color development, drying, heat-setting or other similar purpose, which process causes the antiseptic agent to be decomposed, allowing the waste water containing the ink acceptor thereafter washed out from the ink-jet printed cloth to become easily degradable, as well as antiseptically inactive, not capable of killing bacteria present in activated sludge and otherwise useful in degrading organic waste.

Therefore, the antiseptic agent contained in a useful pretreatment solution to be applied to cloth for ink-jet printing according to the present invention is required to be thermally decomposable at a temperature equal or less than that at which the cloth is to be thermally treated after its ink-jet printing for its drying, color development, heat setting or other similar purpose. Such thermal treatment is normally carried out at a temperature ranging from 80 to 200° C., thus requiring the decomposition of a useful antiseptic agent of the present invention to occur at a temperature of 50 to 200° C.

If the antiseptic agent used in an ink acceptor solution for pretreatment of cloth for ink-jet printing comprising a naturally occurring polymeric thickening agent is thermally decomposable at a temperature less than 50° C., it is subject to progressive degradation at ordinary temperature and therefore poorly stable over time, failing to be capable of performing its function of preventing the degradation of the naturally occurring polymeric thickening agent contained in the pretreatment solution for a long period of time, except for its excessive addition to the solution, which is not desirable, resulting in its excessive add-on to cloth with its insufficient decomposition on the cloth under the subsequent thermal treatment condition recommended by the present invention. Conversely, the use of any antiseptic agent in such a pretreatment solution, the decomposition of which occurs at a temperature of more than 200° C., necessarily requires thermal treatment of cloth pretreated with the solution and thereafter ink-jet printed to be carried out at such a high temperature, which is not desirable, resulting in possible decomposition of the cloth itself. Therefore, a useful antiseptic agent of the present invention should be selected from those thermally decomposable at a temperature ranging from 50 to 200° C.

It should be noted that thermally decomposable temperature as referred to in the present invention is such one that when dissolved any antiseptic agent in water at a concentration of 0.2% for application to cloth which is then subjected to thermal treatment for three minutes at a temperature of 50 to 200° C., the agent on the cloth cannot survive the thermal treatment at a ratio of more than 50%.

Specific examples of such an antiseptic agent thermally decomposable at a temperature of 50 to 200° C. as referred to in the present invention include isothiazoline derivatives such as 5-chloro-2-methyl-4-isothiazoline-3-one, 2-methyl-4-isothiazoline-3-one, 1,2-benzoisothiazoline-3-one, 2-methyl-4, 5-trimethylene-4-isothiazoline-3-one and 2-octyl-4-isothiazoline-3-one, and triazine derivatives such as hexahydro-1,3,5-tris-s-triazine, which can be used either alone or in combination according to the present invention. Among these antiseptic agents, isothiazoline derivatives, especially 5-chloro-2-methyl-4-isothiazoline-3-one and 2-methyl-4-isothiazoline-3-one, are preferable for use in the present invention as they are not only stable over time, but also, when consequently applied to cloth for ink-jet printing as described in the present invention, have no adverse effects upon the ink-jet printing to be subsequently performed on the cloth.

A useful thermally-decomposable antiseptic agent according to the present invention is preferably contained in an ink acceptor solution for pretreatment of cloth for ink-jet printing of the present invention at a concentration of 0.005 to 1% by weight, particularly preferably 0.05 to 0.2% by weight. If the concentration of such an antiseptic agent contained in the pretreatment solution is less than 0.005% by weight, it fails to prevent effectively the degradation of the naturally occurring polymeric thickening agent contained in the solution as an ink acceptor according to the present invention. Conversely, if such an antiseptic agent is contained in the pretreatment solution at a concentration of more than 1% by weight, its resultant add-on to cloth tends to become excessive with its insufficient decomposition on the cloth under the subsequent thermal treatment condition at 50 to 200° C. as proposed in the present invention.

Therefore, an ink acceptor solution for pretreatment of cloth for ink-jet printing according to the present invention is prepared by dissolving one or more of the above-mentioned naturally occurring polymeric thickening agents, and one or more of the above-mentioned thermally-decomposable antiseptic agents within their respective concentration ranges specified in the present invention, and/or any other additive (if necessary to help enhance the usefulness of the present invention, but not resulting in departure from its scope and spirit) in water.

A useful ink acceptor solution for pretreatment of cloth for ink-jet printing according to the present invention is preferable prepared so that its BOD/COD value ranges from 0.3 to 3.0 by selecting the proper combination of its components and their amounts. The BOD/COD value of a certain compound generally represents the biodegradability of the compound. If the compound has a higher BOD/COD value, it is regarded as more easily biodegradable, allowing its easier biological treatment. If such a pretreatment solution as referred to in the present invention is prepared so that its BOD/COD value is less than 0.3, it is considered to be hardly biodegradable and thus cannot be expected to be biologically treated for disposal. Conversely, if the BOD/COD value of the pretreatment solution thus prepared is more than 3.0, it means that it is so easily degradable that it needs excessive addition of an agent for preventing such degradation, which, in turn, adversely influences the cost and working environment involved in the preparation of the solution. According to the present invention, therefore, the BOD/COD value of an ink acceptor solution for pretreatment of cloth for ink-jet printing is adjusted to the above-mentioned range, allowing the ink acceptor applied to the cloth and washed out from it after its ink-jet printing to be disposed of, causing little environmental pollution.

The BOD and COD measurements made in the present invention are based on the following standards:

BOD: JIS K-0102, page 6

COD: JIS K-0102, page 14

In addition, an ink acceptor solution for pretreatment of cloth for ink-jet printing or a cloth pretreated with such a pretreatment solution as proposed in the present invention is preferably prepared with addition of a semi-synthetic polymeric thickness agent to the pretreatment solution, which, to be sure, is inferior in environmental friendliness to its non-synthetic counterpart, but superior to its synthetic counterpart in this respect, and when mixed with a naturally occurring polymeric thickening agent, can be degraded, having no adverse impact on the environment. The reason for the preferred preparation of a useful pretreatment solution of the present invention with addition of a semi-synthetic polymeric thickening agent is that such an agent helps reduce the variation in the viscosity of the solution due to its temperature, pH and other factors that may otherwise occur, and that after it is applied to cloth which is then ink-jet printed and heat-treated, the agent is stable against such heat treatment, allowing uniform distribution of the dyes applied onto the cloth to offer ink-jet printed goods with excellently even coloration. According the present invention, a useful ink acceptor solution for pretreatment of cloth for ink-jet printing preferably contains a semi-synthetic polymeric thickening agent at a concentration of 5 to 40% by weight relative to the naturally occurring polymeric thickening agent dissolved in the solution as its main ink acceptor component as proposed in the present invention. If a semi-synthetic polymeric thickening agent is contained in the pretreatment solution at a concentration in excess of 40% by weight, it may make a greater contribution to the uniform coloration of the resultant ink-jet printed goods according to the present invention, but may become a source of environmental pollution, therefore making its use at such a concentration undesirable. Conversely, a semi-synthetic polymeric thickening agent contained in the pretreatment solution at a concentration of less than 5% may be insufficient to perform such functions as mentioned above.

A useful semi-synthetic polymeric thickening agent of the present invention refers to a chemically-modified naturally occurring substance, specific examples of which include methyl cellulose, ethyl cellulose, hydroxyethyl cellulose, hydroxymethyl cellulose, hydroxyproply cellulose, hydroxypropylmethyl cellulose, carboxymetyl cellulose, carboxymethyl starch, carboxymethyl guar gum, carboxymethyl locust bean gum, carboxymethyl tamarind gum, carboxymethyl tragacanth gum and carboxymethyl xanthan gum.

Among the above-mentioned semi-synthetic polymeric thickening agents, carboxylmethylated water-soluble polysaccharides such as carboxylmethyl cellulose, carboxymethyl starch, carboxymethyl guar gum, carboxymethyl locust bean gum, carboxymethyl tamarind gum, carboxymethyl tragacanth gum and carboxymethyl xanthan gum are preferable for the present invention, because they are excellent in ease of wash-off and ease of handling.

In addition, the preferred carboxymethylated water-soluble polysaccharides of the present invention are ones with an etherification degree of 0.5 to 1.5, more preferably 0.65 to 0.9. Any carboxymethylated water-soluble polysaccharide with an etherification degree of more than 1.5 may pose an environmental pollution problem, while any such one with an etherification degree of less than 0.5 may be hard to dissolve in water, causing problems associated with its handling such as a large variation in the viscosity of the resultant water solution containing it.

Furthermore, a useful ink acceptor solution for pretreatment of cloth for ink-jet printing according to the present invention, because such cloth is of reasonable thickness for use as an ink-jet recording medium, is preferably prepared so that its PVI value ranges from 0.3 to 1.0, indicating that it is sufficiently flowable to penetrate into the inner part of the cloth to a satisfactory extent for subsequent ink-jet printing. If prepared with a PVI value of less than 0.3, such a pretreatment solution, when applied onto cloth as a medium for ink-jet printing, may be insufficiently flowable to achieve uniform distribution over the surface of the cloth with satisfactory penetration into its inner portion. Conversely, if any such pretreatment solution prepared with a PVI value of more than 1.0 is applied onto cloth for a similar purpose, it may be so flowable as to cause its add-on to the cloth to become excessive, resulting in an increase in wasted cost.

The term "PVI value" as used herein refers to a value of any solution determined by the division of the viscosity of the solution measured with a B type viscometer at 60 rps "A" (cps) by that similarly measured at 6 rps "B" (cps), yielding A/B as its quotient.

A useful ink acceptor solution for treatment of cloth for ink-jet printing according to the present invention can be applied to the cloth by using conventionally used methods for application of such solution, including, but not limited to, padding, spraying, dipping, coating, and printing laminating, as well as printing techniques such as gravure printing, ink-jet printing, flat-screen printing, roller printing and rotary screen printing.

In addition, an ink acceptor solution for treatment of cloth for ink-jet printing which is useful in the present invention may be prepared with addition of one or more of volatile inhibitors, catalysts, oil absorbents, antifoaming agents, holding agents, plasticizers, oils, waxes, viscosity controllers, thermosetting resins, cross-linking agents, IR absorbents, UV absorbents, light fastness improvers, antioxidants, extender pigments, fluorescent whiteners, adsorbents, anti-reducing agents, sequestering agents, fillers, moisture absorbents, penetrants, electrolytes, perfumes, deodorants, insecticides and other auxiliaries if necessary to help enhance the usefulness of the present invention, but not resulting in departure from its scope and spirit.

An ink-jet printing process useful in the present invention comprises pretreatment of cloth with such an ink acceptor solution as herein described as a major feature of the present invention and ink-jet printing onto the pretreated cloth, subjecting it to heat treatment either after its pretreatment or ink-jet printing prior to its washing for removal of the ink acceptor applied onto it, if such heat treatment is carried out at such a high temperature as to cause the antiseptic agent present on it to be thermally decomposed as specified in the present invention.

In addition, a useful method for ink-jet printing onto cloth in the ink-jet printing process of the present invention can be selected from continuous ink-jet printing systems such as charge modulating type, micro dotting type, electrostatic charge control type and ink mist type, and on-demand ink-jet printing systems such as piezo type, bubble jet type and electrostatic suction type. A cloth that is useful in the present invention can comprise any type of fiber, including, but not limited to, natural fiber such as cotton, silk, hemp and wool, regenerated fiber such as rayon and cuprammonium rayon, semi-synthetic fiber such as diacetate and triacetate, and synthetic fiber such as acrylic, polyester, nylon 6, nylon 66, poly-lactic acid, polycaprolactam, polybutylene succinate, polyurethane and vinylon, either alone or in combination.

In addition, a useful cloth of the present invention includes, without limitation, fabric such as woven, knitted, non-woven, napped and braided.

A useful ink for ink-jet printing onto cloth according to the present invention can comprise any of a variety of coloring material including, but not limited to, direct dyes, disperse dyes, reactive dyes, acid dyes, basic dyes, cationic dyes, metal complex dyes, oil soluble dyes and pigments according to the fiber of the cloth.

EXAMPLES

To further illustrate the present invention, but not to imply any limitation of the scope of the present invention, the following examples are given together with comparative examples, which are not based on the present invention.

Example 1

An ink acceptor solution for pretreatment of cloth for ink-jet printing was prepared according to the following recipe and procedure as Pretreatment Solution 1.

[Pretreatment Solution 1]

| | |
|---|---|
| SUN ALGIN MVR (Naturally occurring polymeric thickening agent based on sodium alginate; prepared by Sansho Co., Ltd.) | 2.4% |
| MARPOLOSE M-25 (Semi-synthetic polymeric thickening agent based on methylcellulose; prepared by Matsumoto Yushi-Seiyaku Co., Ltd.) | 0.6% |
| Malic acid (diluted with water to 50%) | 0.5% |
| REACTANT MS (Anti-reductant; prepared by Uni Kasei Co., Ltd.) | 1% |
| KATHON PFM (Thermally decomposable antiseptic agent based on 5-chloro-2-methyl-4-isothiazoline-3-one and 2-methyl-4-isothiazoline-3-one; prepared by Rohm and Haas) | 0.2% |
| Water | Balance |
| Total | 100% |

BOD/COD value = 0.48
PVI value = 0.58

Of the above recipe ingredients, SUN ALGIN MVR, MARPOLOSE M-25, Malic acid and REACTANT MS were mixed with water and stirred for 30 minutes into a solution, to which the remaining ingredient KATHON PFM was added and stirred for another 10 minutes to prepare Pretreatment Solution 1.

Polyester 100% napped fabric was desized and scoured according to a procedure normally practiced for desizing and scouring such fabric.

The polyester 100% napped fabric was treated with the Pretreatment Solution 1 using a rotary screen printing method to apply the solution onto its surface to be ink-jet recorded. The pretreated fabric was hot-air dried at 150° C. for 3 minutes.

The dried fabric was printed using an ink-jet printer connected to a computer installed with data for control of the printer's nozzle injection pressure, nozzle opening/closing, recording medium position, cartridge travel and other necessary parameters for proper application of ink onto the fabric's printing surface.

The ink was prepared according to the following recipe and applied to the fabric under the inkjet printing condition described below.

[Ink Recipe]

| | |
|---|---|
| C. I. Disperse Red 127 | 5% |
| Anionic surface active agent | 4% |
| SHIN-ETSU SILICONE KM-70 (antifoaming agent, made by Shin-Etsu Chemical Co., Ltd.) | 0.05% |
| Ethylene glycol | 3% |
| Silicic acid | 0.1% |
| Ion exchanged water | Balance |
| Total | 100% |

[Ink-jet Printing Condition]
Ink-jet printer: On-demand serial scanning type
Nozzle diameter: 50 $\mu$m
Drive voltage: 100V
Frequency: 5 kHz
Resolution: 360 dpi The ink-jet printed fabric was then subjected to wet heat treatment at 150° C. for 10 minutes.

The wet-heat treated fabric was soaped by immersion in a soaping liquor (prepared according to the recipe specified below) in a liquor ratio of 100:1 at 80° C. for 30 minutes before drying to obtain it as end printed goods.

[Soaping Liquor Recipe]

| | |
|---|---|
| Sodium hydroxide | 1% |
| LIPOTOL TC-300 (Soaping agent, made by Nicca Chemical Co., Ltd.) | 0.2% |
| Warm water | Balance |
| Total | 100% |

[Evaluation]

The Pretreatment Solution 1 and the ink-jet printed fabric prepared in Example 1 and their respective counterparts prepared in Examples 2 to 5 and Comparative Examples 1 to 3, which are described in sequence subsequently to this example, were evaluated on the following items as applicable. The results of the evaluation are shown in Table 1.

1) Stability Over Time

Each of the pretreatment solutions prepared in the examples and comparative examples was allowed to stand in a thermostatic chamber controlled at a temperature of 25° C. and measured for viscosity using a B type viscometer on a daily basis to determine the number of days taken until it underwent a sharp drop in its viscosity as the time period during which it remained stable.

Judgment

The judgment of the solution for its stability over time is based on the number of days during which it remained stable, being expressed as an absolute value; therefore, it is more stable over time if the value is larger.

2) Thermal Stability of Ink Accepting Layer

The ink accepting layer used in each of the pretreatment solutions prepared in the examples and comparative examples was examined for its thermal stability by evaluating the difference between the fabric pretreated with the solution, dried at 170° C. and ink-jet printed (A) and the same fabric similarly pretreated and ink-jet printed, but dried at 150° C. (B) in their color shades, determined as a difference of their respective K/S values (K: absorption coefficient, S: scattering coefficient) according to the following expression:

$$\text{Color shade difference}=(B\text{'s } K/S \text{ value})-(A\text{'s } K/S \text{ value})$$

Judgment

The judgment of the antiseptic agent contained in the solution for its thermal stability is based on the above-mentioned color shade difference, being expressed as an absolute value; therefore, it is more thermally-unstable and less heat-resistant if the value is larger.

3) Degradability of Waste Water Produced from Ink-Jet Printed Fabric as a Result of its Wash-Off The waste water produced as a result of the soaping of the fabric pretreated with each of the pretreatment solutions prepared in the examples and comparative examples, dried, ink-jet printed and heat-treated for color development, which thus contained the ink accepting layer washed off from the ink-jet printed fabric, was collected and held in a thermostatic bath controlled at a temperature of 28±2° C. To the collected waste water, a septic solution (composed of peptone, sodium chloride, meat extract and bacteria (*Bacillus subtilis, Escherichia coli, Pseudomonas aeruginosa*) conditioned with the bacteria present in the solution at a concentration of $10^5$ counts/ml) was added at a concentration of 1% and incubated for two days. The incubated waste water was subjected to viable bacterial count to evaluate the effect of the washed-off ink accepting layer upon the viable bacterial in the waste water. The results of the evaluation were judged according to the following three-grade (○Δ×) scale.

Judgment

○: Viable bacteria count not less than $10^4$/ml

Δ: Viable bacteria count not less than $10^2$/ml, but less than $10^4$/ml

×: Viable bacteria count less than $10^2$/ml

Example 2

An ink acceptor solution for pretreatment of cloth for ink-jet printing was prepared according to the following recipe and procedure as Pretreatment Solution 2.

[Pretreatment Solution 2]

| | |
|---|---|
| SUN ALGIN MVR (Naturally occurring polymeric thickening agent based on sodium alginate; prepared by Sansho Co., Ltd.) | 2.7% |
| FINE GUM HE (Semi-synthetic polymeric thickening agent based on CMC; prepared by Dai-ichi Kogyo Seiyaku Co., Ltd.) | 0.3% |
| Malic acid (diluted with water to 50%) | 0.5% |
| REACTANT MS (Anti-reductant; prepared by Uni Kasei Co., Ltd.) | 1% |
| BESTCIDE 200K (Thermally decomposable antiseptic agent based on 1,2-benzoisothiazoline-3-one; prepared by Dainippon Ink and Chemicals, Incorporated) | 0.05% |
| Water | Balance |
| Total | 100% |

BOD/COD value = 0.56
PVI value = 0.70

Of the above recipe ingredients, SUN ALGIN MVR, MARPOLOSE M-25, malic acid and REACTANT MS were mixed with water and stirred for 30 minutes into a solution, to which the remaining ingredient BESTCIDE 200K was added and stirred for another 10 minutes to prepare Pretreatment Solution 2.

Example 2 was implemented pursuant to Example 1, except that Pretreatment Solution 2 was used in place of the Pretreatment Solution 1 used in Example 1.

Example 3

Example 3 was implemented pursuant to Example 1, except that polyester spandex fabric was used in place of the polyester napped fabric used in Example 1.

Example 4

Example 4 was implemented pursuant to Example 1, except that the pretreatment solution was applied to the fabric by a coating method instead of the rotary screen printing method used in Example 1.

Example 5

An ink acceptor solution for pretreatment of cloth for ink-jet printing was prepared according to the following recipe and procedure as Pretreatment Solution 3.

[Pretreatment Solution 3]

| | |
|---|---|
| SUN ALGIN MVR (Naturally occurring polymeric thickening agent based on sodium alginate; prepared by Sansho Co., Ltd.) | 2.4% |
| Malic acid (50% aqueous solution) | 0.5% |
| REACTANT MS (Anti-reductant; prepared by Uni Kasei Co., Ltd.) | 1% |
| KATHON PFM (Thermally decomposable antiseptic agent based on 5-chloro-2-methyl-4-isothiazoline-3-one and 2-methyl-4-isothiazoline-3-one; prepared by Rohm and Haas) | 0.2% |
| Water | Balance |
| Total | 100% |

BOD/COD value = 0.65
PVI value = 0.72

Example 5 was implemented pursuant to Example 1, except that Pretreatment Solution 3 was used in place of the Pretreatment Solution 1 used in Example 1.

Comparative Example 1

An ink acceptor solution for pretreatment of cloth for ink-jet printing was prepared according to the following recipe and procedure as Pretreatment Solution 4.

[Pretreatment Solution 4]

| | |
|---|---|
| SUN ALGIN MVR (Naturally occurring polymeric thickening agent based on sodium alginate; prepared by Sansho Co., Ltd.) | 2.4% |
| MARPOLOSE M-25 (Semi-synthetic polymeric thickening agent based on methylcellulose; prepared by Matsumoto Yushi-Seiyaku Co., Ltd.) | 0.6% |
| Malic acid (50% aqueous solution) | 0.5% |
| REACTANT MS (Anti-reductant; prepared by Uni Kasei Co., Ltd.) | 1% |
| Water | Balance |
| Total | 100% |

BOD/COD value = 0.48
PVI value = 0.60

Comparative Example 1 was implemented pursuant to Example 1, except that Pretreatment Solution 4 was used in place of the Pretreatment Solution 1 used in Example 1.

Comparative Example 2

An ink acceptor solution for pretreatment of cloth for ink-jet printing was prepared according to the following recipe and procedure as Pretreatment Solution 5.

[Pretreatment Solution 5]

| | |
|---|---|
| Polyvinyl alcohol (Synthetic polymeric thickening agent; prepared by Kuraray Co., Ltd.) | 5% |
| Malic acid (50% aqueous solution) | 0.5% |
| REACTANT MS (Anti-reductant; prepared by Uni Kasei Co., Ltd.) | 1% |
| KATHON PFM (Thermally decomposable antiseptic agent based on 5-chloro-2-methyl-4-isothiazoline-3-one and 2-methyl-4-isothiazoline-3-one; prepared by Rohm and Haas) | 0.2% |
| Water | Balance |
| Total | 100% |

BOD/COD value = 0.01
PVI value = 0.35

Comparative Example 2 was implemented pursuant to Example 1, except that Pretreatment Solution 5 was used in place of the Pretreatment Solution 1 used in Example 1.

Comparative Example 3

An ink acceptor solution for pretreatment of cloth for ink-jet printing was prepared according to the following recipe and procedure as Pretreatment Solution 6.

[Pretreatment Solution 6]

| | |
|---|---|
| FINE GUM HE (Semi-synthetic polymeric thickening agent based on CMC; prepared by Dai-ichi Kogyo Seiyaku Co., Ltd.) | 3% |
| Malic acid (50% aqueous solution) | 0.5% |
| REACTANT MS (Anti-reductant; prepared by Uni Kasei Co., Ltd.) | 1% |
| PREVENTOL A-3 (Antiseptic agent based on N-(fluorodichloromethylthio) phthalimide) | 0.05% |
| Water | Balance |
| Total | 100% |

BOD/COD value = 0.03
PVI value = 0.70

Comparative Example 3 was implemented pursuant to Example 1, except that Pretreatment Solution 6 was used in place of the Pretreatment Solution 1 used in Example 1.

As can be clearly seen from Table 1, the pretreatment solutions prepared as proposed in the present invention are all excellent in storage stability, while the fabric pretreated with any one of these solutions according to the present invention has the great advantage of environmental friendliness.

In contrast, any of the pretreatment solutions not prepared according to the present invention as represented by Comparative Example 2 or 3, although excellent in storage stability, may present a problem of environmental pollution due to poor degradability of waste water produced from the ink-jet printed fabric pretreated with the solution as a result of its wash-off for removal of the ink accepting layer formed on it, and may otherwise incur time and cost in disposing of the waste water in an appropriate manner, making any such pretreatment solution disadvantageous.

TABLE 1

| | Example 1 | Example 2 | Example 3 | Example 4 | Example 5 | Comparative Example 1 | Comparative Example 2 | Comparative Example 3 |
|---|---|---|---|---|---|---|---|---|
| Stability over time | 49 | 35 | 49 | 49 | 21 | 3 | 63 | 56 |
| Color shade difference | 0.05 | 0.04 | 0.05 | 0.05 | 0.12 | 0.05 | 0.06 | 0.07 |
| Waste water degradability | ○ | ○ | ○ | ○ | ◎ | ○ | Δ | X |

The four grade (◎○ΔX) scale for rating the degradability of the waste water in the above table is defined as follows - ◎: Excellent, ○: Good, Δ: Poor and X: Extremely poor.

As described hereinbefore, an ink acceptor solution for treatment of cloth for ink-jet printing according to the present invention has such excellent storage stability that it can reduce the burden on workers involved in handling such solution. In addition a cloth pretreated with such an ink acceptor solution for ink-jet printing according to the present invention or an ink-jet printing process for cloth involving the application of such pretreatment solution, which allows the ink accepting layer formed on the cloth to be disposed of after completion of its function in such a state that it is biodegradable, has the great advantage of having no adverse impact on the environment, being friendly to the earth. Furthermore ink-jet printed goods manufactured according to the present invention are not less inferior in color image quality and brightness to those manufactured by prior art, as well as excellent in tactile characteristics.

What is claimed is:

1. An ink acceptor solution for pretreatment of cloth for ink-jet printing, which comprises a naturally occurring polymeric thickening agent dissolved in water as an ink acceptor and an antiseptic agent thermally decomposable at a temperature of 50° C. to 200° C. and has a BOD/COD value ranging from 0.3 to 3.

2. An ink acceptor solution for pretreatment of cloth for ink-jet printing as claimed in claim 1, which further contains a semi-synthetic polymeric thickening agent and in which said semi-synthetic polymeric thickening agent is contained at a concentration of 5% to 40% by weight relative to said naturally occurring polymeric thickening agent.

3. An ink acceptor solution for pretreatment of cloth for ink-jet printing as claimed in claim 2, in which said semi-synthetic polymeric thickening agent is a carboxymethylated water-soluble polysaccharide.

4. An ink acceptor solution for pretreatment of cloth for ink-jet printing as claimed in claim 2, having a PVI value which ranges from 0.3 to 1.0.

5. A cloth for ink-jet printing, which has an ink accepting layer comprising a naturally occurring polymeric thickening agent as an ink acceptor, a semi-synthetic polymeric thickening agent and an antiseptic agent thermally decomposable at a temperature of 50° C. to 200° C. and in which said semi-synthetic polymeric thickening agent is contained at a concentration of 5% to 40% by weight relative to said naturally occurring polymeric thickening agent.

6. A cloth for ink-jet printing as claimed in claim 5, in which said semi-synthetic polymeric thickening agent is a carboxymethylated water-soluble polysaccharide.

7. An ink-jet printing process, which comprises:

(1) pretreating cloth with a pretreatment solution comprising a naturally occurring polymeric thickening agent dissolved in water as an ink acceptor and an antiseptic agent thermally decomposable at a temperature of from 50° C. to 200° C., said ink acceptor solution having a BOD/COD value ranging from 0.3 to 3, to form an ink accepting layer on the cloth;

(2) ink-jet printing onto the pretreated cloth;

(3) thermally treating the ink-jet printed cloth to decompose the antiseptic agent contained in the ink accepting layer; and, (4) washing the thermally-treated cloth to remove the ink accepting layer from it.

8. An ink-jet printing process as claimed in claim 7, in which said pretreatment solution further contains a semi-synthetic polymeric thickening agent and in which said semi-synthetic polymeric thickening agent is contained in said pretreatment solution at a concentration of 5% to 40% by weight relative to the naturally occurring polymeric thickening agent.

9. An ink jet printing process as claimed in claim 8 in which said semi-synthetic polymeric thickening agent contained in said pretreatment solution is a carboxymethylated water-soluble polysaccharide.

10. An ink-jet printing process as claimed in claim 7, in which the pretreatment solution has a PVI value which ranges from 0.3 to 1.0.

11. An ink-jet printing process as claimed in claim 7, in which the amounts of said naturally occurring polymeric thickening agent, antiseptic agent and water are 1.0% to 10% by weight, 0.0050% to 1% by weight and 70% to 99.9% by weight, respectively, based on the weight of said pretreatment solution.

* * * * *